US008444827B2

(12) United States Patent
Quigley

(10) Patent No.: US 8,444,827 B2
(45) Date of Patent: May 21, 2013

(54) STRUCTURED FABRIC

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 182 days.

(21) Appl. No.: 13/019,337

(22) Filed: Feb. 2, 2011

(65) Prior Publication Data

US 2012/0193052 A1 Aug. 2, 2012

(51) Int. Cl.
*D21F 3/00* (2006.01)

(52) U.S. Cl.
USPC ..... 162/358.2; 139/383 A

(58) Field of Classification Search
USPC ..... 162/358.2
See application file for complete search history.

(56) References Cited

U.S. PATENT DOCUMENTS

| | | | | |
|---|---|---|---|---|
| 4,528,239 | A | 7/1985 | Trokhan | |
| 5,429,686 | A | 7/1995 | Chiu et al. | |
| 6,237,644 | B1 | 5/2001 | Hay et al. | |
| 7,585,395 | B2 | 9/2009 | Quigley et al. | |
| 2004/0053688 | A1 | 3/2004 | Hosaka | |
| 2004/0089363 | A1 * | 5/2004 | Josef et al. | 139/383 A |
| 2005/0050198 | A1 | 3/2005 | Mizoguchi | |
| 2007/0209770 | A1 * | 9/2007 | Barrett et al. | 162/358.2 |
| 2009/0308558 | A1 | 12/2009 | Quigley | |

FOREIGN PATENT DOCUMENTS

| | | | |
|---|---|---|---|
| EP | 1837439 | A2 | 9/2007 |
| WO | 2005073461 | A1 | 8/2005 |
| WO | 2006/113818 | A1 | 10/2006 |
| WO | 2009069046 | A1 | 6/2009 |
| WO | 2010069695 | A1 | 6/2010 |

* cited by examiner

*Primary Examiner* — Jacob Thomas Minskey
(74) *Attorney, Agent, or Firm* — Taylor IP, P.C.

(57) ABSTRACT

A structured fabric for use in a papermaking machine for forming a web of fibrous material includes a repeating weave pattern that includes a plurality of warp yarns, warp knuckles, weft yams and weft knuckles that form two different types of pockets each of which include a plurality of margins and a bottom and is open on the web-facing side are formed between the knuckles, wherein the weft yarns have a first group, but not the second group, that form weft knuckles and the second group, but not the first group, form at least part of the bottom of the pockets formed.

19 Claims, 8 Drawing Sheets

STRUCTURED FABRIC

BACKGROUND OF THE INVENTION

1. Field of the Invention

The present invention relates to papermaking, and, more particularly, to a structured fabric employed in papermaking.

2. Description of the Related Art

In a conventional papermaking process, a water slurry, or suspension, of cellulosic fibers (known as the paper "stock") is fed into a gap between two endless woven wires that travel between two or more rolls. At least one of the wires is often referred to as a "structured fabric" that provides a papermaking surface on the upper surface of its upper run which operates as a filter to separate the cellulosic fibers of the paper stock from the aqueous medium, thereby forming a wet paper web. The aqueous medium drains through mesh openings of the structured fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermakers' fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the structured fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and the like) the papermaking surface comprises a very finely woven or fine wire mesh structure.

In a conventional tissue forming machine, the sheet is formed flat. At the press section, 100% of the sheet is pressed and compacted to reach the necessary dryness and the sheet is further dried on a Yankee and hood section. The sheet is then creped and wound-up, thereby producing a flat sheet.

In an ATMOS™ system, a sheet is formed on a structured or molding fabric and the sheet is further sandwiched between the structured or molding fabric and a dewatering fabric. The sheet is dewatered through the dewatering fabric and opposite the molding fabric. The dewatering takes place with airflow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet is dried by a Yankee/Hood dryer arrangement and then dry creped. In the ATMOS™ system, one and the same structured fabric is used to carry the sheet from the headbox to the Yankee dryer. Using the ATMOS™ system, the sheet reaches between about 35 to 38% dryness after the ATMOS™ roll, which is almost the same dryness as a conventional press section. However, this advantageously occurs with almost 40 times lower nip pressure and without compacting and destroying sheet quality. Furthermore, a big advantage of the ATMOS™ system is that it utilizes a permeable belt which is highly tensioned, e.g., about 60 kN/m. This belt enhances the contact points and intimacy for maximum vacuum dewatering. Additionally, the belt nip is more than 20 times longer than a conventional press and utilizes airflow through the nip, which is not the case on a conventional press system.

Actual results from trials using an ATMOS™ system have shown that the caliper and bulk of the sheet is 30% higher than the conventional through-air drying (TAD) formed towel fabrics. Absorbency capacity is also 30% higher than with conventional TAD formed towel fabrics. The results are the same whether one uses 100% virgin pulp up to 100% recycled pulp. Sheets can be produced with basis weight ratios of between 14 to 40 g/m$^2$. The ATMOS™ system also provides excellent sheet transfer to the Yankee working at 33 to 37% dryness. A key aspect of the ATMOS™ system is that it forms the sheet on the molding fabric and the same molding fabric carries the sheet from the headbox to the Yankee dryer. This produces a sheet with a uniform and defined pore size for maximum absorbency capacity.

U.S. Patent Application Publication No. to QUIGLEY, the disclosure of which is hereby expressly incorporated by reference herein in its entirety, discloses a fabric for making a bulky web. The fabric includes a machine-facing side and a web-facing side including pockets formed by machine direction yarns and cross-machine direction yarns, but more machine direction yarns than cross-machine direction yarns. Adjacent pockets are offset from each other and are defined by machine direction and cross-machine direction knuckles.

U.S. Pat. No. 5,429,686 to CHIU et al., the disclosure of which is hereby expressly incorporated by reference herein in its entirety, discloses a throughdrying fabric for the drying section of a papermaking machine. The fabric has a load-bearing layer and a sculpture layer. The sculpture layer is characterized by impression machine direction knuckles formed as warp knuckles floating over a plurality of shutes but positioned substantially above the tops of the lowest shute knuckles in the load-bearing layer so as to provide machine direction knuckles projecting in the sculpture layer.

International Publication No. WO 2006/113818 to KROLL et al., the disclosure of which is hereby expressly incorporated by reference herein in its entirety, discloses a through-air-drying fabric for producing tissue paper and related products on a papermaking machine includes a plurality of warp yarns interwoven with a plurality of weft yarns to produce a paper-side surface pattern characterized by alternating first pockets and second pockets. The first and second pockets are bounded by raised warp yarns and raised weft yarns produced by knuckles in the fabric pattern. The first pockets are preferably larger in area than the second pockets. The fabric base weave in the interior of the first pocket is preferably a plain weave pattern. The interior of the second pocket may also be bisected by a raised weft yarn.

What is needed in the art is an efficient effective fabric weave pattern to be used in a papermaking machine.

SUMMARY OF THE INVENTION

The present invention provides an efficient effective fabric weave pattern to be used in a papermaking machine.

The invention in one form is directed to a structured fabric for use in a papermaking machine for forming a web of fibrous material. The structured fabric includes: a plurality of warp yarns; and a plurality of weft yarns, the plurality of warp and weft yarns being interwoven with one another in a repeating weave pattern, forming a web-facing side of the structured fabric, and forming a plurality of pockets each of which includes a plurality of margins and a bottom and is open on the web-facing side. The repeating weave pattern includes: the plurality of warp yarns including a plurality of warp knuckles each formed by floating over adjacent ones of the plurality of weft yarns on the web-facing side, the plurality of weft yarns including a first group of weft yarns and a second group of weft yarns, the first group of weft yarns, but not the second group of weft yarns, forming a plurality of weft knuckles each formed by floating over adjacent ones of the plurality of warp yarns on the web-facing side, the plurality of warp and weft knuckles being configured for impressing the web, the second group of weft yarns, but not the first group of weft yarns, forming at least partially a respective bottom of each of the plurality of pockets, the plurality of pockets including a first type of pocket and a second type of pocket, the plurality of margins of the first type of pocket being formed only by the plurality of warp knuckles, the plurality of margins of the second type of pocket being formed by both the plurality of warp knuckles and the plurality of weft knuckles.

The invention in another form is directed to a papermaking machine for forming a web of fibrous material. The papermaking machine includes: a structured fabric for use in the papermaking machine. The structured fabric includes: a plurality of warp yarns; and a plurality of weft yarns, the plurality of warp and weft yarns being interwoven with one another in a repeating weave pattern, forming a web-facing side of the structured fabric, and forming a plurality of pockets each of which includes a plurality of margins and a bottom and is open on the web-facing side. The repeating weave pattern includes: the plurality of warp yarns including a plurality of warp knuckles each formed by floating over adjacent ones of the plurality of weft yarns on the web-facing side, the plurality of weft yarns including a first group of weft yarns and a second group of weft yarns, the first group of weft yarns, but not the second group of weft yarns, forming a plurality of weft knuckles each formed by floating over adjacent ones of the plurality of warp yarns on the web-facing side, the plurality of warp and weft knuckles being configured for impressing the web, the second group of weft yarns, but not the first group of weft yarns, forming at least partially a respective bottom of each of the plurality of pockets, the plurality of pockets including a first type of pocket and a second type of pocket, the plurality of margins of the first type of pocket being formed only by the plurality of warp knuckles, the plurality of margins of the second type of pocket being formed by both the plurality of warp knuckles and the plurality of weft knuckles.

The invention in yet another form is directed to a web of fibrous material including: a fibrous construct having at least one formed surface feature, the surface feature including a topographical pattern reflective of a repeating weave pattern in a fabric used in a papermaking machine. The fabric is a structured fabric and includes: a plurality of warp yarns; and a plurality of weft yarns, the plurality of warp and weft yarns being interwoven with one another in the repeating weave pattern, forming a web-facing side of the structured fabric, and forming a plurality of pockets each of which includes a plurality of margins and a bottom and is open on the web-facing side. The repeating weave pattern includes: the plurality of warp yarns including a plurality of warp knuckles each formed by floating over adjacent ones of the plurality of weft yarns on the web-facing side, the plurality of weft yarns including a first group of weft yarns and a second group of weft yarns, the first group of weft yarns, but not the second group of weft yarns, forming a plurality of weft knuckles each formed by floating over adjacent ones of the plurality of warp yarns on the web-facing side, the plurality of warp and weft knuckles being configured for impressing the web, the second group of weft yarns, but not the first group of weft yarns, forming at least partially a respective bottom of each of the plurality of pockets, the plurality of pockets including a first type of pocket and a second type of pocket, the plurality of margins of the first type of pocket being formed only by the plurality of warp knuckles, the plurality of margins of the second type of pocket being formed by both the plurality of warp knuckles and the plurality of weft knuckles.

An advantage of the present invention is that it forms deep pockets.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

The particulars shown herein are by way of example and for purposes of illustrative discussion of embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, and the description is taken with the drawings making apparent to those skilled in the art how the forms of the present invention may be embodied in practice.

The present invention relates to a structured fabric for a papermaking machine, a former for manufacturing a paper web, and also to a former which utilizes the structured fabric, and in some embodiments a belt press, in a papermaking machine.

The present invention also relates to a twin wire former ATMOS™ system which utilizes the structured fabric which has good resistance to pressure and excessive tensile strain forces, and which can withstand wear/hydrolysis effects that are experienced in an ATMOS™ system. The system may also include a permeable belt for use in a high tension extended nip around a rotating roll or a stationary shoe and a dewatering fabric for the manufacture of premium tissue or towel grades. The fabric has key parameters which include permeability, weight, caliper, and certain compressibility.

Figure 1:
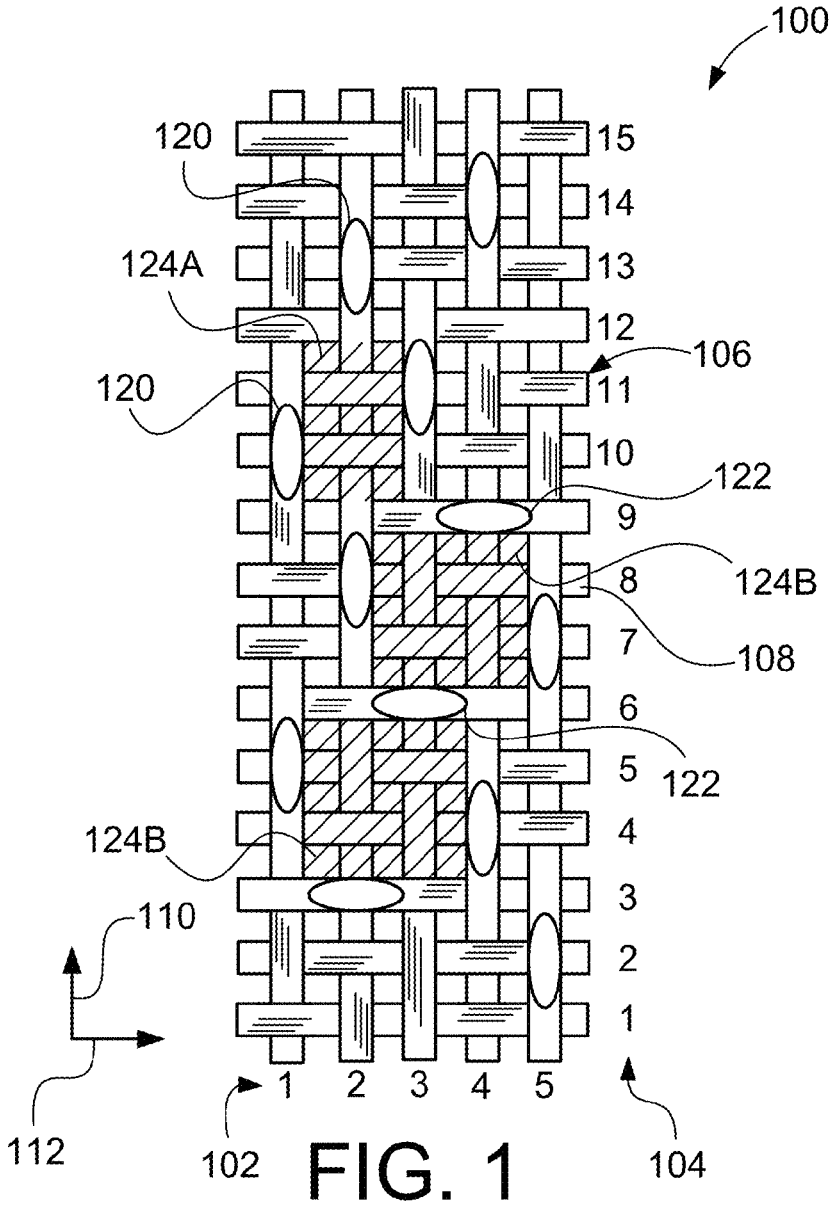
FIG. 1 is a top view of a web-facing side of a structured fabric according to the present invention.
Figure 3:
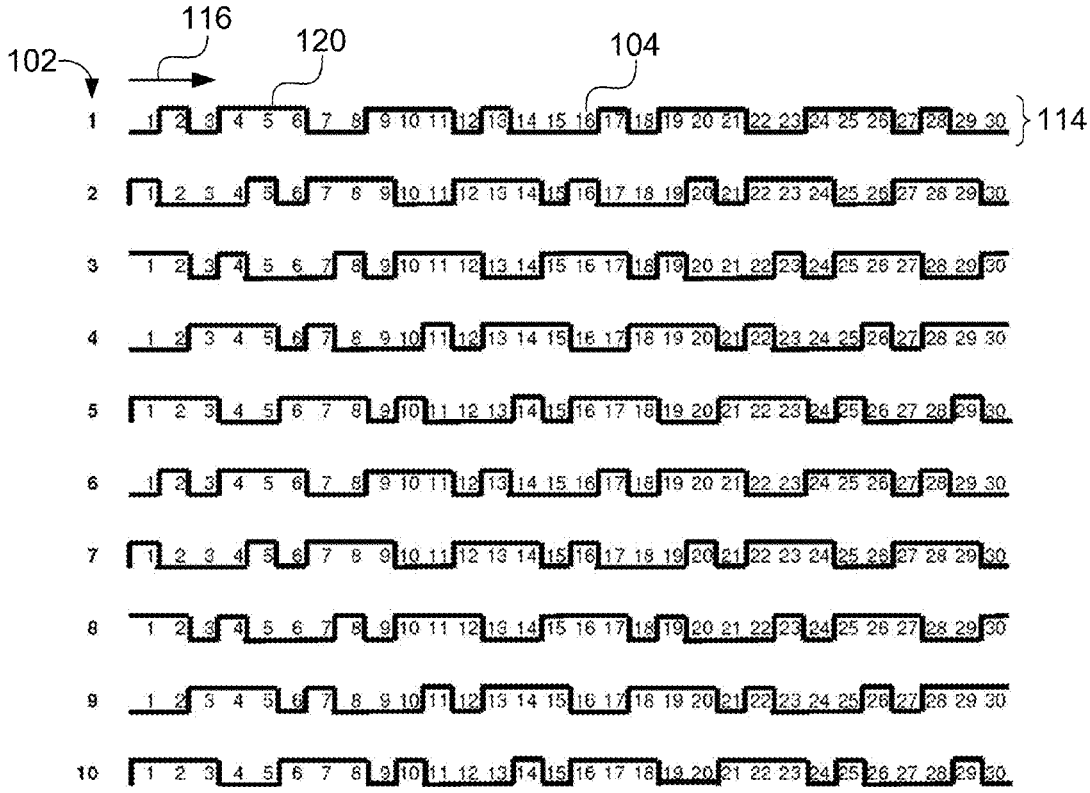
FIG. 3 is a weave pattern showing the warp yarn paths of the structured fabric of FIG. 2.

Referring now to the drawings, and more particularly to FIG. 1, there is shown a structured fabric 100 of the present invention for use in a papermaking machine for forming a web 38 of fibrous material. Embodiments of the papermaking machine according to the present invention are shown in FIGS. 7-13. An embodiment of web 38 according to the present invention is shown in FIGS. 6-13. Structured fabric 100 generally includes a plurality of warp yarns 102 and a plurality of weft yarns 104, warp and weft yarns 102, 104 interweaving with one another in a repeating weave pattern 106 and forming a web-facing side 108 of structured fabric 100. FIG. 1 shows that the warp yarns are generally labeled as 102 and are individually labeled as warp yarns 1, 2, 3, 4, and 5. Further, FIG. 1 shows that the weft yarns are generally labeled as 104 and are individually labeled as weft yarns 1, 2, 3, 4, 5, 6, 7, 8, 9, 10, 11, 12, 13, 14, and 15. FIG. 1 shows structured fabric 100 from a top view of web-facing side 108 of structured fabric 100 (that is, a view of the papermaking surface of structured fabric 100). FIG. 1 shows a single repeating weave pattern 106 of structured fabric 100 on web-facing side 108. Warp yarns 102 extend in a machine direction 110 of structured fabric 100 relative to the papermaking machine, and weft yarns 104 extend in a cross-machine direction 112 of structured fabric 100 relative to the papermaking machine. Repeating weave pattern 106, according to the embodiment of the present invention described herein, is formed by a single layer 114 of warp and weft yarns 102, 104 and has five warp yarns (i.e., warp yarns 1-5) and fifteen weft yarns (i.e., weft yarns 1-15) weaving together. The layer 114 is generally shown in FIG. 3 relative to a single warp yarn path. Although a single layer is described, the layer 114 can include weft yarns 104 which run substantially on separate cross-sectional planes within structured fabric 100, as further described below (the separate planes are not shown in the drawings).

Figure 2:
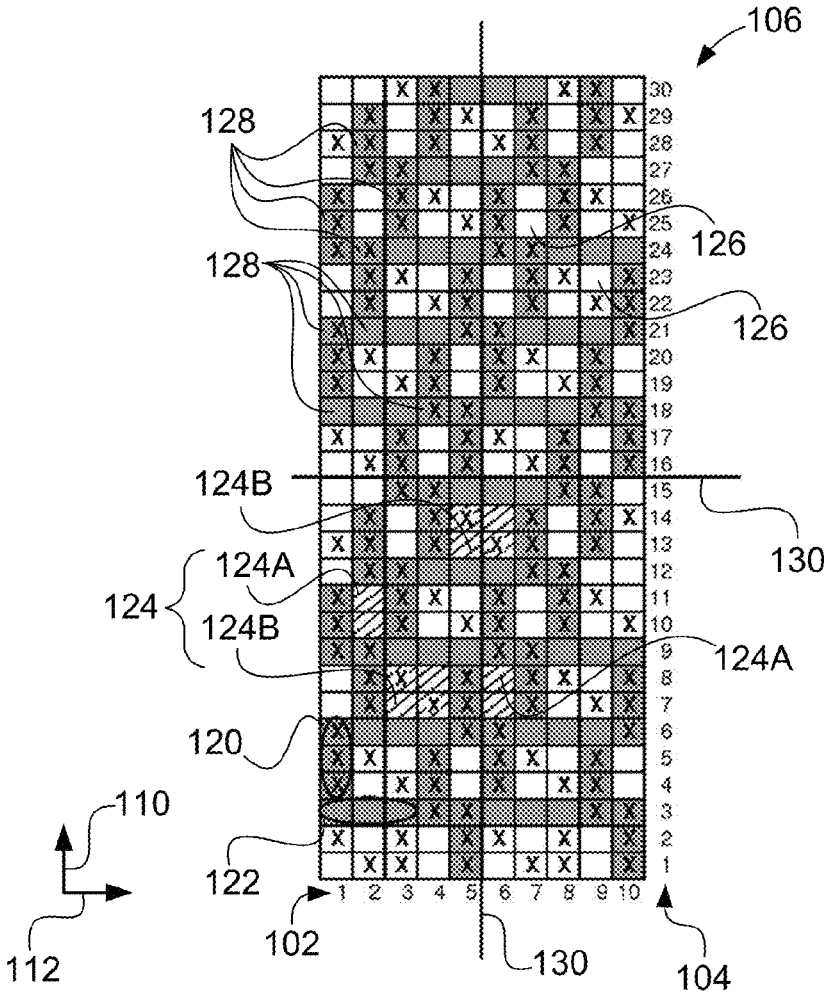
FIG. 2 is a weave pattern diagram showing a top view of the web-facing side of a repeating weave pattern of the structured fabric of FIG. 1, four of the repeating weave pattern being shown.

FIG. 2 illustrates a weave pattern diagram of structured fabric 100. FIG. 2 diagramatically shows weave pattern 106 of FIG. 1 repeated four times. The four weave patterns 106 are highlighted using the bolded crossing lines 130 through the diagram of FIG. 2. FIG. 2 shows warp yarns 102 as warps yarns 1, 2, 3, 4, 5, 6, 7, 8, 9, and 10 and weft yarns 104 as weft yarns 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30. FIG. 2 shows structured fabric 100 from a top view of web-facing side 108 of structured fabric 100 (that is, a view of the papermaking surface of structured fabric 100). Structured fabric 100 can include more of repeating weave pattern 106. A box with the symbol "X" in FIG. 1 illustrates a location where a warp yarn 102 passes over a weft yarn 104 on web-facing side 108 of structured fabric 100. A box which does not have an X illustrates a location where a warp yarn 102 passes under a weft yarn 104 on web-facing side 108 of structured fabric 100 (stated another way, the weft yarn 104 passes over the warp yarn 102 in such a box).

FIG. 3 illustrates the weave pattern 106 of warp yarns 102 relative to weft yarns 104, as shown in FIG. 2. The first number on the left is the warp yarn number (as indicated by the reference number 102), and the remaining numbers in each line proceeding from left to right are weft yarns 104. The line is the pattern (or, warp path 116) of a respective warp yarn 102. Since FIG. 3 also shows four of repeating weave pattern 106, FIG. 3 shows the first repeating weave pattern 106 extending in warp yarns 1-5 from weft yarns 1 to weft yarns 15, the second repeating weave pattern 106 extending in warp yarns 1-5 to from weft yarns 16 to weft yarns 30, the third repeating weave pattern 106 extending in warp yarns 6-10 from weft yarns 1 to weft yarns 15, and the fourth repeating weave pattern 106 extending in warp yarns 6-10 from weft yarns 16 to weft yarns 30. Each repeating weave pattern 106 is identical to one another.

FIG. 3 thus shows the warp paths 116 of warp yarns 1-10 in FIG. 2. Warp yarn 1 weaves, relative to web-facing side 108, under weft yarn 1, over weft yarn 2, under weft yarn 3, over weft yarns 4, 5, and 6, under weft yarns 7 and 8, over weft yarns 9, 10, and 11, under weft yarn 12, over weft yarn 13, under weft yarns 14 and 15, under weft yarn 16, over weft yarn 17, under weft yarn 18, over weft yarns 19, 20, and 21, under weft yarns 22 and 23, over weft yarns 24, 25, and 26, under weft yarn 27, over weft yarn 28, and under weft yarns 29 and 30. Warp yarn 2 weaves, relative to web-facing side 108, over weft yarn 1, under weft yarns 2, 3, and 4, over weft yarn 5, under weft yarn 6, over weft yarns 7, 8, and 9, under weft yarns 10 and 11, over weft yarns 12, 13, and 14, under weft yarn 15, over weft yarn 16, under weft yarns 17, 18, and 19, over weft yarn 20, under weft yarn 21, over weft yarns 22, 23, and 24, under weft yarns 25 and 26, over weft yarns 27, 28, and 29, and under weft yarn 30. Warp yarn 3 weaves, relative to web-facing side 108, over weft yarns 1 and 2, under weft yarn 3, over weft yarn 4, under weft yarns 5, 6, and 7, over weft yarn 8, under weft yarn 9, over weft yarns 10, 11 and 12, under weft yarns 13 and 14, over weft yarn 15, over weft yarns 16 and 17, under weft yarn 18, over weft yarn 19, under weft yarns 20, 21, and 22, over weft yarn 23, under weft yarn 24, over weft yarns 25, 26, and 27, under weft yarns 28 and 29, and over weft yarn 30. Warp yarn 4 weaves, relative to web-facing side 108, under weft yarns 1 and 2, over weft yarns 3, 4, and 5, under weft yarn 6, over weft yarn 7, under weft yarns 8, 9, and 10, over weft yarn 11, under weft yarn 12, over weft yarns 13, 14, and 15, under weft yarns 16 and 17, over weft yarns 18, 19, and 20, under weft yarn 21, over weft yarn 22, under weft yarns 23, 24, and 25, over weft yarn 26, under weft yarn 27, and over weft yarns 28, 29, and 30. Warp yarn 5 weaves, relative to web-facing side 108, over weft yarns 1, 2, and 3, under weft yarns 4 and 5, over weft yarns 6, 7, and 8, under weft yarn 9, over weft yarn 10, under weft yarns 11, 12, and 13, over weft yarn 14, under weft yarn 15, over weft yarns 16, 17, and 18, under weft yarns 19 and 20, over weft yarns 21, 22, and 23, under weft yarn 24, over weft yarn 25, under weft yarns 26, 27, and 28, over weft yarn 29, and under weft yarn 30.

Further, warp yarn 6 weaves, relative to web-facing side 108, under weft yarn 1, over weft yarn 2, under weft yarn 3, over weft yarns 4, 5, and 6, under weft yarns 7 and 8, over weft yarns 9, 10, and 11, under weft yarn 12, over weft yarn 13, under weft yarns 14 and 15, under weft yarn 16, over weft yarn 17, under weft yarn 18, over weft yarns 19, 20, and 21, under weft yarns 22 and 23, over weft yarns 24, 25, and 26, under weft yarn 27, over weft yarn 28, and under weft yarns 29 and 30. Thus, warp yarn 6 has the same weave path 116 as warp yarn 1. Warp yarn 7 weaves, relative to web-facing side 108, over weft yarn 1, under weft yarns 2, 3, and 4, over weft yarn 5, under weft yarn 6, over weft yarns 7, 8, and 9, under weft yarns 10 and 11, over weft yarns 12, 13, and 14, under weft yarn 15, over weft yarn 16, under weft yarns 17, 18, and 19, over weft yarn 20, under weft yarn 21, over weft yarns 22, 23, and 24, under weft yarns 25 and 26, over weft yarns 27, 28, and 29, and under weft yarn 30. Thus, warp yarn 7 has the same weave path 116 as warp yarn 2. Warp yarn 8 weaves, relative to web-facing side 108, over weft yarns 1 and 2, under weft yarn 3, over weft yarn 4, under weft yarns 5, 6, and 7, over weft yarn 8, under weft yarn 9, over weft yarns 10, 11 and 12, under weft yarns 13 and 14, over weft yarn 15, over weft yarns 16 and 17, under weft yarn 18, over weft yarn 19, under weft yarns 20, 21, and 22, over weft yarn 23, under weft yarn 24, over weft yarns 25, 26, and 27, under weft yarns 28 and 29, and over weft yarn 30. Thus, warp yarn 8 has the same weave path 116 as warp yarn 3. Warp yarn 9 weaves, relative to web-facing side 108, under weft yarns 1 and 2, over weft yarns 3, 4, and 5, under weft yarn 6, over weft yarn 7, under weft yarns 8, 9, and 10, over weft yarn 11, under weft yarn 12, over weft yarns 13, 14, and 15, under weft yarns 16 and 17, over weft yarns 18, 19, and 20, under weft yarn 21, over weft yarn 22, under weft yarns 23, 24, and 25, over weft yarn 26, under weft yarn 27, and over weft yarns 28, 29, and 30. Thus, warp yarn 9 has the same weave path 116 as warp yarn 4. Warp yarn 10 weaves, relative to web-facing side 108, over weft yarns 1, 2, and 3, under weft yarns 4 and 5, over weft yarns 6, 7, and 8, under weft yarn 9, over weft yarn 10, under weft yarns 11, 12, and 13, over weft yarn 14, under weft yarn 15, over weft yarns 16, 17, and 18, under weft yarns 19 and 20, over weft yarns 21, 22, and 23, under weft yarn 24, over weft yarn 25, under weft yarns 26, 27, and 28, over weft yarn 29, and under weft yarn 30. Thus, warp yarn 10 has the same weave path 116 as warp yarn 5.

Figure 4:
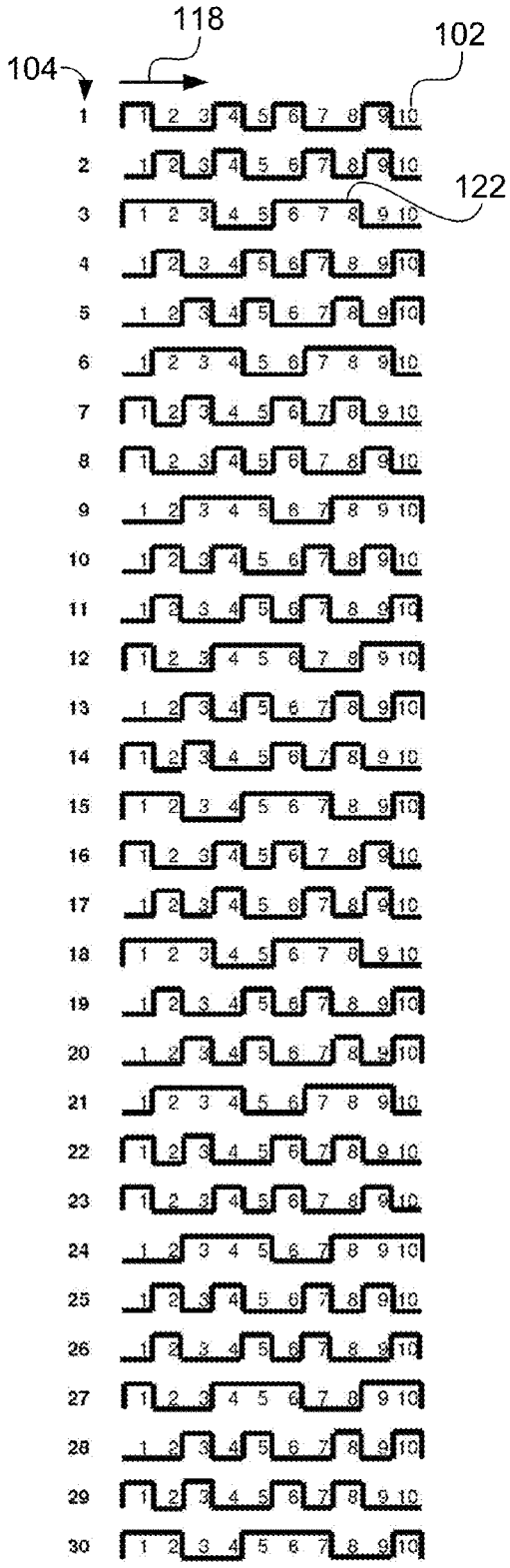
FIG. 4 is a weave pattern shown the weft yarn paths of the structured fabric of FIG. 2.

FIG. 4 illustrates the weave pattern of weft yarns 104 relative to warp yarns 102, as shown in FIGS. 2 and 3. The first number on the left is the weft yarn number (as indicated by the reference number 104), and the remaining numbers in each line proceeding from left to right are warp yarns 102. The line is the pattern (or, weft path 118) of a respective weft yarn 104. Like FIGS. 2 and 3, FIG. 4 also shows four of repeating weave pattern 106. Weft yarn 1 weaves, relative to web-facing side 108, over warp yarn 1, under warp yarns 2 and 3, over warp yarn 4, under warp yarn 5, over warp yarn 6, under warp yarns 7 and 8, over warp yarn 9, and under warp yarn 10. Weft yarn 2 weaves, relative to web-facing side 108, under warp yarn 1, over warp yarn 2, under warp yarn 3, over warp yarn 4, under warp yarns 5 and 6, over warp yarn 7, under warp yarn 8, over warp yarn 9, and under warp yarn 10. Weft yarn 3 weaves, relative to web-facing side 108, over warp yarns 1, 2, and 3, under warp yarns 4 and 5, over warp yarns 6, 7, and 8, and under warp yarns 9 and 10. Weft yarn 4 weaves, relative to web-facing side 108, under warp yarn 1, over warp yarn 2, under warp yarns 3 and 4, over warp yarn 5, under warp yarn 6, over warp yarn 7, under warp yarns 8 and 9, and over warp yarn 10. Weft yarn 5 weaves, relative to web-facing side 108, under warp yarns 1 and 2, over warp yarn 3, under warp yarn 4, over warp yarn 5, under warp yarns 6 and 7, over warp yarn 8, under warp yarn 9, and over warp yarn 10. Weft yarn 6 weaves, relative to web-facing side 108, under warp yarn 1, over warp yarns 2, 3 and 4, under warp yarns 5 and 6, over warp yarns 7, 8, and 9, and under warp yarn 10. Weft yarn 7 weaves, relative to web-facing side 108, over warp yarn 1, under warp yarn 2, over warp yarn 3, under warp yarns 4 and 5, over warp yarn 6, under warp yarn 7, over warp yarn 8, and under warp yarns 9 and 10. Weft yarn 8 weaves, relative to web-facing side 108, over warp yarn 1, under warp yarns 2 and 3, over warp yarn 4, under warp yarn 5, over warp yarn 6, under warp yarns 7 and 8, over warp yarn 9, and under warp yarn 10. Weft yarn 9 weaves, relative to web-facing side 108, under warp yarns 1 and 2, over warp yarns 3, 4, and 5, under warp yarns 6 and 7, and over warp yarns 8, 9, and 10. Weft yarn 10 weaves, relative to web-facing side 108, under warp yarn 1, over warp yarn 2, under warp yarn 3, over warp yarn 4, under warp yarns 5 and 6, over warp yarn 7, under warp yarn 8, over warp yarn 9, and under warp yarn 10. Weft yarn 11 weaves, relative to web-facing side 108, under warp yarn 1, over warp yarn 2, under warp yarns 3 and 4, over warp yarn 5, under warp yarn 6, over warp yarn 7, under warp yarns 8 and 9, and over warp yarn 10. Weft yarn 12 weaves, relative to web-facing side 108, over warp yarn 1, under warp yarns 2 and 3, over warp yarns 4, 5, and 6, under warp yarns 7 and 8, and over warp yarns 9 and 10. Weft yarn 13 weaves, relative to web-facing side 108, under warp yarns 1 and 2, over warp yarn 3, under warp yarn 4, over warp yarn 5, under warp yarns 6 and 7, over warp yarn 8, under warp yarn 9, and under warp yarn 10. Weft yarn 14 weaves, relative to web-facing side 108, over warp yarn 1, under warp yarn 2, over warp yarn 3, under warp yarns 4 and 5, over warp yarn 6, under warp yarn 7, over warp yarn 8, and under warp yarns 9 and 10. Weft yarn 15 weaves, relative to web-facing side 108, over warp yarns 1 and 2, under warp yarns 3 and 4, over warp yarns 5, 6, and 7, under warp yarns 8 and 9, and over warp yarn 10.

Further, as shown in FIG. 4, weft yarn 16 has the same weave path 118 as weft yarn 1. Weft yarn 17 has the same weave path as weft yarn 2. Weft yarn 18 has the same weave path 118 as weft yarn 3. Weft yarn 19 has the same weave path as weft yarn 4. Weft yarn 20 has the same weave path 118 as weft yarn 5. Weft yarn 21 has the same weave path 118 as weft yarn 6. Weft yarn 22 has the same weave path 118 as weft yarn 7. Weft yarn 23 has the same weave path as weft yarn 8. Weft yarn 24 has the same weave path 118 as weft yarn 9. Weft yarn 25 has the same weave path 118 as weft yarn 10. Weft yarn 26 has the same weave path 118 as weft yarn 11. Weft yarn 27 has the same weave path 118 as weft yarn 12. Weft yarn 28 has the same weave path 118 as weft yarn 13. Weft yarn 29 has the same weave path 118 as weft yarn 14. Weft yarn 30 has the same weave path 118 as weft yarn 15.

Further, weft yarns 1-15 can be grouped into five sections of three weft yarns 104, the five sections being weft yarns 1-3, weft yarns 4-6, weft yarns 7-9, weft yarns 10-12, and weft yarns 13-15. Weft yarns 4-6 correspond respectively to weft yarns 1-3 but are offset one warp yarn 102 to the right in FIG. 4 relative to weft yarns 1-3. Similarly, weft yarns 7-9 correspond respectively to weft yarns 4-6 but are offset one warp yarn 102 to the right in FIG. 4 relative to weft yarns 4-6. Similarly, weft yarns 10-12 correspond respectively to weft yarns 7-9 but are offset one warp yarn 102 to the right in FIG. 4 relative to weft yarns 7-9. Similarly, weft yarns 13-15 correspond respectively to weft yarns 10-12 but are offset one warp yarn 102 to the right in FIG. 4 relative to weft yarns 10-12.

Figure 6:
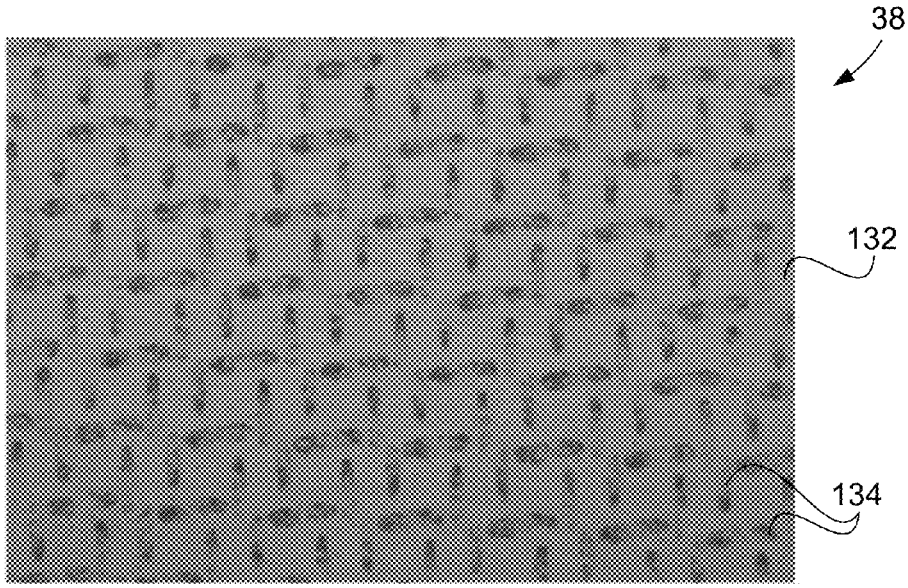
FIG. 6 is an illustration of a paper impression made by the structured fabric of FIGS. 1-5.

FIGS. 1-3 show that repeating weave pattern 106 provides that warp yarns 102 include a plurality of warp knuckles 120 each formed by floating over adjacent weft yarns 104 on web-facing side 108. Warp knuckles 120 can be formed by floating over at least three adjacent weft yarns 104 on web-facing side 108. Thus, FIG. 2 shows each warp knuckle 120 as three consecutive boxes where each box includes an X and is shaded. One such warp knuckle in FIG. 2 is circled and labeled as 120. FIG. 3 shows an exemplary warp knuckle labeled as 120. FIG. 1 shows each warp knuckle 120 as a vertically oriented ellipse on a respective warp yarn 102. FIG. 1 shows an exemplary warp knuckle labeled as 120. Further, the vertical ellipses in FIG. 1 can also be understood to be approximations of that portion of the respective warp yarn 102 which impresses the web 38. Thus, warp knuckles 120 of repeating weave pattern 106 are configured for impressing web 38, as shown in FIG. 6.

Each warp yarn 102 of repeating weave pattern 106 includes at least one warp knuckle 120. Warp yarn 1 forms one warp knuckle 120 when weaving over weft yarns 4, 5, and 6 and another warp knuckle 120 when weaving over weft yarns 9, 10, and 11. Warp yarn 2 forms one warp knuckle 120 when weaving over weft yarns 7, 8, and 9 and another warp knuckle 120 when weaving over weft yarns 12, 13, and 14. Warp yarn 3 forms a warp knuckle 120 when weaving over weft yarns 10, 11, and 12. Warp yarn 4 forms one warp knuckle 120 when weaving over weft yarns 3, 4, and 5 and another warp knuckle 120 when weaving over weft yarns 13, 14, and 15. Warp yarn 5 forms one warp knuckle 120 when weaving over weft yarns 1, 2, and 3 and another warp knuckle 120 when weaving over weft yarns 6, 7, and 8.

A respective warp knuckle 120 of each warp yarn 102 is offset relative to another respective warp knuckle 120 of a respective adjacent warp yarn 102 by three weft yarns 104 in machine direction 110. More specifically, as described above, each warp yarn 102 of the repeating weave pattern 106 weaves, relative to web-facing side 108, the following warp path 116 relative to the respective weft yarn 104: over three weft yarns 104, under two weft yarns 104, over three weft yarns 104, under one weft yarn 104, over one weft yarn 104, under three weft yarns 104, over one weft yarn 104, under one weft yarn 104. This is shown from start-to-finish by warp yarn 5 extending across weft yarns 1-15. Each warp yarn 102 of the weave pattern 106 weaves this same path 116 but is offset relative to each other in the weave pattern 106. For instance, the warp path 116 described in this paragraph can be said to start at weft yarn 4 for warp yarn 1, at weft yarn 7 for warp yarn 2, at weft yarn 10 for warp yarn 3, at weft yarn 13 for warp yarn 4, and, as stated, at weft yarn 1 for warp yarn 5. Thus, as shown in FIG. 2, the warp path 116 of warp yarn 2 is offset in machine direction 110 by three weft yarns 104 relative to warp yarn 1. The warp path 116 of warp yarn 3 is offset in machine direction 110 by three weft yarns 104 relative to warp yarn 2. The warp path 116 of warp yarn 4 is offset in machine direction 110 by three weft yarns 104 relative to warp yarn 3. The warp path 116 of warp yarn 5 is offset in machine direction 110 by three weft yarns 104 relative to warp yarn 4. The warp path 116 of warp yarn 1 is offset in machine direction 110 by three weft yarns 104 relative to warp yarn 5. Stated another way, in repeating weave pattern 106, warp yarns 102 include at least one warp yarn n and at least one warp yarn n+1, the warp path 116 for each warp yarn n+1 is offset in machine direction 110 by three weft yarns 104 relative to warp yarn n.

FIGS. 1, 2, and 4 show that repeating weave pattern 106 provides that weft yarns 104 include a plurality of weft knuckles 122 each formed by floating over adjacent warp yarns 102 on web-facing side 108. Weft knuckles 122 can be formed by floating over at least three adjacent warp yarns 102 on web-facing side 108. Thus, FIG. 2 shows each weft knuckle 122 as three consecutive boxes where each box does not include an X but is shaded. One such weft knuckle in FIG. 2 is circled and labeled as 122. FIG. 4 shows an exemplary weft knuckle labeled as 122. FIG. 1 shows each weft knuckle 122 as a horizontally oriented ellipse on a respective weft yarn 104. FIG. 1 shows an exemplary weft knuckle labeled as 122. Further the horizontal ellipses in FIG. 1 can also be understood to be approximations of that portion of the respective weft yarn 104 which impresses the web 38. Thus, weft knuckles 122 of repeating weave pattern 106 are configured for impressing web 38, as shown in FIG. 6.

Weft yarn 3 forms a weft knuckle 122 when weaving over warp yarns 1, 2, and 3. Weft yarn 6 forms a weft knuckle 122 when weaving over warp yarns 2, 3, and 4. Weft yarn 9 forms a weft knuckle 122 when weaving over warp yarns 3, 4, and 5.

Repeating weave pattern 106 provides that weft yarns 104 include a first group of weft yarns 104 and a second group of weft yarns 104. The first group of weft yarns 104, but not the second group of weft yarns 104, forms each of the weft knuckles 122 of repeating weave pattern 106. FIGS. 1, 2, and 4 show that the weft yarns 104 forming weft knuckles 122 of a single repeating weave pattern 106 are weft yarns 3, 6, and 9. Thus, the first group of weft yarns 104 in a single repeating weave pattern 106 is weft yarns 3, 6, and 9.

Warp and weft yarns 102, 104 of structured fabric 100 also form a plurality of pockets 124 in repeating weave pattern 106. Each pocket 124 is open on web-facing side 108 and includes a bottom 126 and a plurality of margins 128. The second group of weft yarns 104, but not the first group of weft yarns 104, forms at least partially a respective bottom 126 of each pocket 124 of repeating weave pattern 106. FIGS. 1, 2, and 4 show that the weft yarns 104 at least partially forming the bottoms 126 of the pockets 124 in a single repeating weave pattern 106 are weft yarns 4, 5, 7, 8, 10, and 11. Thus, the second group of weft yarns 104 in a single repeating weave pattern 106 is weft yarns 4, 5, 7, 8, 10, and 11. Further, as shown in FIGS. 1-4, not only do the second group of weft yarns 104 not form any weft knuckles 122 over three adjacent warp yarns 102, no weft yarn 104 of the second group of weft yarns 104 weaves over adjacent warp yarns 102.

Further, warp and weft knuckles 120, 122 form the margins 128 of each of the pockets 124 in repeating weave pattern 106. More specifically, the repeating weave pattern 106 provides that the plurality of pockets 124 include a first type of pocket 124A and a second type of pocket 124B. The margins 128 of the first type of pocket 124A are formed only by warp knuckles 120. Stated another way, each of the margins 128 of each pocket 124 of the first type of pocket 124A is formed only by warp knuckles 120. For example, FIG. 2 shows four warp knuckles 120 forming the margins 128 of a first type of pocket 124A; this particular pocket 124A has a left margin 128 formed by a warp knuckle 120 formed by warp yarn 1 floating over weft yarns 9, 10, and 11, a right margin 128 formed by a warp knuckle 120 formed by warp yarn 3 floating over weft yarns 10, 11, and 12, a lower margin 128 formed by a warp knuckle 120 formed by warp yarn 2 floating over weft yarns 7, 8, and 9, and an upper margin 128 formed by a warp knuckle 120 formed by warp yarn 2 floating over weft yarns 12, 13, and 14, and a bottom 126 formed by weft yarns 10 and 11 being over warp yarn 2. It is understood that left, right, lower, and upper margins 128 are in reference to a viewer of the page of FIGS. 1 and 2. The bottom 126 of this pocket 124A is formed by weft yarns 10 and 11 being over warp yarn 2. As shown in FIGS. 1 and 2, a single repeating weave pattern 106 has only one pocket 124 of the first type of pocket 124A. For illustrative purposes, FIGS. 1 and 2 show exemplary pockets 124A with diagonal lines.

The margins 128 of the second type of pocket 124B are formed by both warp knuckles 120 and weft knuckles 122. Stated another way, each of the margins 128 of each pocket 124 of the second type of pocket 124 is formed by warp and weft knuckles 120, 122 cooperating together. For example, FIG. 2 shows two warp knuckles 120 and two weft knuckles 122 forming the margins 128 of a second type of pocket 124B; the two warp knuckles 120 of this pocket 124B are formed by warp yarn 1 floating over weft yarns 4, 5, and 6 and warp 4 floating over weft yarns 3, 4, and 5, and the two weft knuckles 122 of this pocket 124B are formed by weft yarn 3 floating over warp yarns 1, 2, and 3 and weft yarn 6 floating over warp yarns 2, 3, and 4. As shown in FIGS. 1 and 2, a single repeating weave pattern 106 has only two pockets 120 of the second type of pocket 124B. The bottom 126 of the second type of pocket 124B is formed by two weft yarns 104 and two warp yarns 102. For example, the bottom 126 of one pocket 124 of the second type 124B is formed by weft yarn 7 being over warp yarn 3, weft yarn 8 being over warp yarn 4, warp yarn 3 being over weft yarn 8, and warp yarn 4 being over weft yarn 7. For illustrative purposes, FIGS. 1 and 2 show exemplary pockets 124B with diagonal lines.

Thus, the weft yarns 104 of the first group of weft yarns 104 impress the web 38 with their respective weft knuckles 122 but do not form any part of the bottoms 126 of any of the pockets 124. The weft yarns 104 of the second group of weft yarns 104 at least partly form the bottoms 126 of the pockets 124 but do not impress the web 38. As a result, the weft yarns 104 of the first group of weft yarns 104 are on a plane higher than that of the weft yarns 104 of the second group of weft yarns 104. Stated another way, the first group of weft yarns 104 substantially occupies a first plane within structured fabric 100, the second group of weft yarns 104 substantially occupies a second plane within the structured fabric 100, and the first plane is higher than the second plane (when viewing a cross-section of structured fabric 100 with web-facing side 108 oriented upwardly). Accordingly, structured fabric 100 has deep pockets 120 which generate more sheet caliper, bulk, and absorbency.

Further, when structured fabric 100 includes two of repeating weave pattern 106 which are adjacent one another in cross-machine direction 112 (i.e., warps 1-10 by wefts 1-15 in FIG. 2), FIG. 2 shows that structured fabric 100 forms four pockets 124 of the first type of pocket 124A and six pockets 124 of the second type of pocket 124B by way of two of the repeating weave pattern 106. Further, FIG. 2 shows that at least two weft knuckles 122 are formed across the junction 130 of the two adjacent ones of repeating weave pattern. Junction 130 is seamless. Junction 130 is shown by a bolded line in FIG. 2 merely for illustrative purposes.

Figure 5:
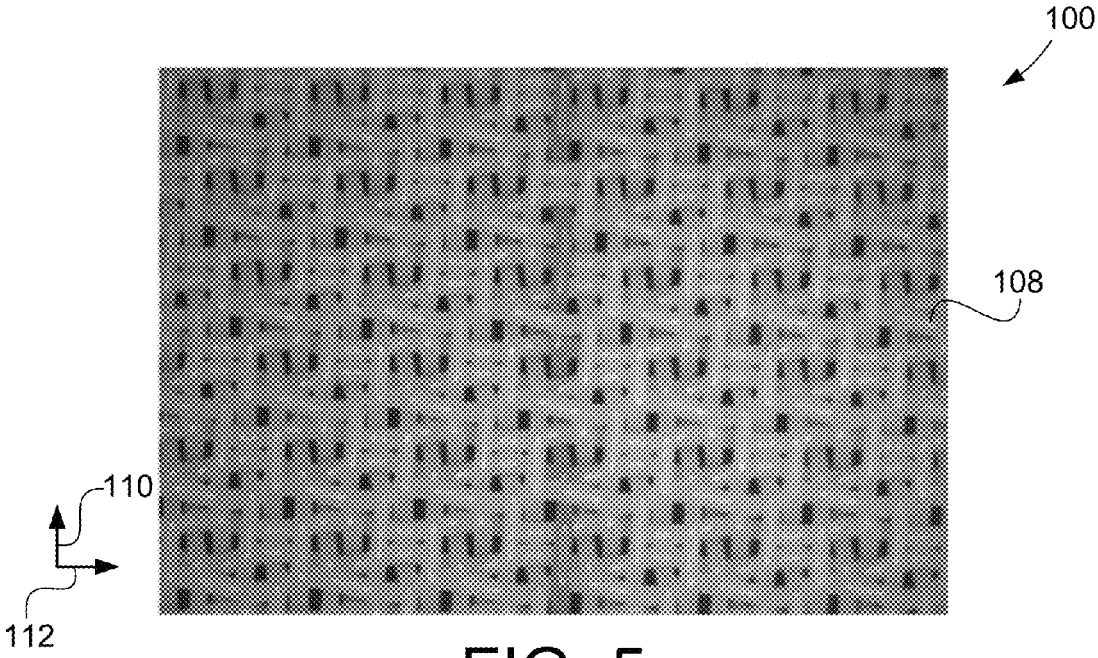
FIG. 5 is a photograph of the web-facing side of the structured fabric of FIG. 1.

FIG. 5 shows a photograph of web-facing side 108 of structured fabric 100 according to the present invention. Warp yarns 102 and weft yarns 104 are shown in FIG. 5.

The embodiment shown in FIGS. 1-5 is illustrative of the structured fabric 100 of the present invention. The present invention is not limited to the weave pattern 106 shown therein.

The present invention further provides a web 38 of fibrous material, web 38 including a fibrous construct 132 having at least one formed surface feature 134. The surface feature 134 includes a topographical pattern 134 reflective of repeating weave pattern 106 in fabric 100 used in a papermaking machine (exemplary embodiments of the papermaking machine according to the present invention are shown in FIGS. 7-13). The fabric 100 is structured fabric 100, as described above. FIG. 6 is a picture of the impressions made by structured fabric 100 on a piece of paper, which can be considered a web 38 of fibrous material according to the present invention. FIG. 6 shows a plurality of impressions 134 formed by structured fabric 100. More specifically, the impressions 134 on the paper in FIG. 6 were formed by warp knuckles 120 and weft knuckles 122 of web-facing side 108 of structured fabric 100.

The parameters of the structured fabric shown in FIGS. 1-5 can have a mesh (number of warp yarns per inch) and a count (number of weft yarns per inch) of any amount. The single-layered fabric may have a high permeability value due to the nature of a single layer fabric and the way it is woven. Regarding yarn dimensions, the particular size of the yarns is typically governed by the mesh of the papermaking surface and the yarn size can be selected based upon the intended use. Fabrics employing these yarn sizes may be implemented with polyester yarns or with a combination of polyester and nylon yarns.

The structured fabric can also be treated and/or coated with an additional polymeric material that is applied by, e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduced drive loads. The treatment/coating can be applied to impart/improve one or several of these properties of the fabric. As indicated previously, the topographical pattern in the paper web can be changed and manipulated by use of different single-layer weaves. Further enhancement of the pattern can be attained by adjustments to the specific fabric weave by changes to the yarn diameter, yarn counts, yarn types, yarn shapes, permeability, caliper and the addition of a treatment or coating etc. In addition, a printed design, such as a screen-printed design, of polymeric material can be applied to the fabric to enhance its ability to impart an aesthetic pattern into the web or to enhance the quality of the web. Finally, one or more surfaces of the fabric or molding belt can be subjected to sanding and/or abrading in order to enhance surface characteristics.

The characteristics of the individual yarns utilized in the fabric of the present invention can vary depending upon the desired properties of the final papermakers' fabric. For example, the materials comprising yarns employed in the fabric of the present invention may be those commonly used in papermakers' fabric. As such, the yarns may be formed of polypropylene, polyester, nylon, or the like. The skilled artisan should select a yarn material according to the particular application of the final fabric.

By way of non-limiting example, the structured fabric is a single-layered woven fabric which can withstand high pressures, heat, moisture concentrations, and which can achieve a high level of water removal and also mold or emboss the paper web. These characteristics provide a structured fabric appropriate for the Voith ATMOS™ papermaking process. The fabric preferably has a width stability and a suitable high permeability and preferably utilizes hydrolysis and/or temperature resistant materials, as discussed above. The fabric is preferably a woven fabric that can be installed on an ATMOS™ machine as a pre-joined and/or seamed continuous and/or endless belt. Alternatively, the structured fabric can be joined in the ATMOS™ machine using, e.g., a pin-seam arrangement or can otherwise be seamed on the machine.

The invention also provides for utilizing the structured fabric disclosed herein on a machine for making a fibrous web, e.g., tissue or hygiene paper web, etc., which can be, e.g., a twin wire and a permeable belt ATMOS™ system. Referring again to the drawings, and more particularly to FIGS. 7-13, there is a fibrous web machine including a headbox 31 that discharges a fibrous slurry between a forming fabric 35 and a structured fabric 100 having a weave pattern 106. It should be understood that structured fabric 100 is an embodiment of the structured fabric discussed above in connection with FIGS. 1-6. Rollers 37 and 32 direct fabric 35 in such a manner that tension is applied thereto, against the slurry and structured fabric 100. Structured fabric 100 is supported by forming roll 34 which rotates with a surface speed that matches the speed of structured fabric 100 and forming fabric 35. Structured fabric 100 has peaks and valleys as defined by weave pattern 106, which give a corresponding structure to web 38 formed thereon. Structured fabric 100 travels in a web direction, and as moisture is driven from the fibrous slurry, structured fibrous web 38 takes form. The moisture that leaves the slurry travels through forming fabric 35.

The fibrous slurry is formed into a web 38 with a structure that matches the shape of structured fabric 100. Forming fabric 35 is porous and allows moisture to escape during forming. Further, water is removed through dewatering fabric 82. The removal of moisture through fabric 82 does not cause compression of web 38 traveling on structured fabric 100.

Due to the formation of the web 38 with the structured fabric 100 the pockets (i.e., pockets 124) of the fabric 100 are fully filled with fibers. Therefore, at the Yankee surface 52 the web 38 has a much higher contact area, up to approximately 100%, as compared to the prior art because the web 38 on the side contacting the Yankee surface 52 is almost flat.

Figure 7:
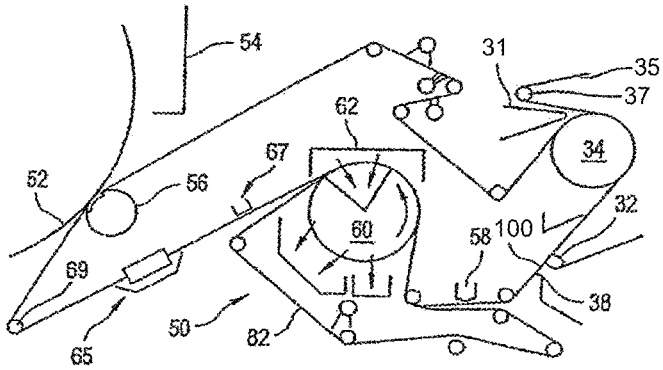
FIG. 7 illustrates a schematic cross-sectional view of an embodiment of an ATMOS™ papermaking machine.

Referring to FIG. 7, there is shown an embodiment of the process where a structured fibrous web 38 is formed. Structured fabric 100 carries a three dimensional structured fibrous web 38 to an advanced dewatering system 50, past vacuum box 67 and then to a position where the web is transferred to Yankee dryer 52 and hood section 54 for additional drying and creping before winding up on a reel (not shown).

A shoe press 56 is placed adjacent to structured fabric 100, holding fabric 100 in a position proximate Yankee dryer 52. Structured fibrous web 38 comes into contact with Yankee dryer 52 and transfers to a surface thereof, for further drying and subsequent creping.

A vacuum box 58 is placed adjacent to structured fabric 100 to achieve improved solids levels. Web 38, which is carried by structured fabric 100, contacts dewatering fabric 82 and proceeds toward vacuum roll 60. Vacuum roll 60 operates at a vacuum level of −0.2 to −0.8 bar with a preferred operating level of at least −0.4 bar. Hot air hood 62 is optionally fit over vacuum roll 60 to improve dewatering.

Optionally a steam box can be installed instead of the hood 62 supplying steam to the web 38. The steam box preferably has a sectionalized design to influence the moisture re-dryness cross profile of the web 38. The length of the vacuum zone inside the vacuum roll 60 can be from 200 mm to 2,500 mm, with a preferable length of 300 mm to 1,200 mm and an even more preferable length of between 400 mm to 800 mm. The solids level of web 38 leaving suction roll 60 is 25% to 55% depending on installed options. A vacuum box 67 and hot air supply 65 can be used to increase web 38 solids after vacuum roll 60 and prior to Yankee dryer 52. Wire turning roll 69 can also be a suction roll with a hot air supply hood. As discussed above, roll 56 includes a shoe press with a shoe width of 80 mm or higher, preferably 120 mm or higher, with a maximum peak pressure of less than 2.5 MPa. To create an even longer nip to facilitate the transfer of web 38 to Yankee dryer 52, web 38 carried on structured fabric 100 can be brought into contact with the surface of Yankee dryer 52 prior to the press nip associated with shoe press 56. Further, the contact can be maintained after structured fabric 100 travels beyond press 56.

Figure 8:
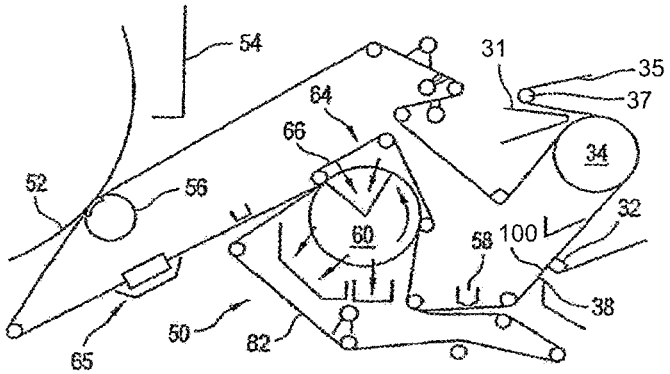
FIG. 8 illustrates a schematic cross-sectional view of another embodiment of an ATMOS™ papermaking machine.

Now, additionally referring to FIG. 8, there is shown yet another embodiment of the present invention, which is substantially similar to the invention illustrated in FIG. 7, except that instead of hot air hood 62, there is a belt press 64. Belt press 64 includes a permeable belt 66 capable of applying pressure to the machine side of structured fabric 100 that carries web 38 around vacuum roll 60. Fabric 66 of belt press 64 is also known as an extended nip press belt or a link fabric, which can run at 60 KN/m fabric tension with a pressing length that is longer than the suction zone of roll 60.

Preferred embodiments of the fabric 66 and the required operation conditions are also described in PCT/EP2004/053688 and PCT/EP2005/050198 which are herewith incorporated by reference.

The above mentioned references are also fully applicable for dewatering fabrics 82 and press fabrics 66 described in the further embodiments.

Belt 66 is a specially designed extended nip press belt 66, made of, for example reinforced polyurethane and/or a spiral link fabric. Belt 66 also can have a woven construction. Such a woven construction is disclosed, e.g., in EP 1837439. Belt 66 is permeable thereby allowing air to flow therethrough to enhance the moisture removing capability of belt press 64. Moisture is drawn from web 38 through dewatering fabric 82 and into vacuum roll 60.

Figure 9:
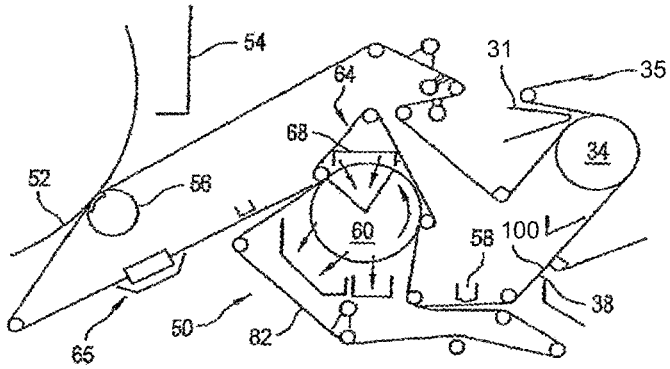
FIG. 9 illustrates a schematic cross-sectional view of another embodiment of an ATMOS™ papermaking machine.

Referring to FIG. 9, there is shown another embodiment of the present invention which is substantially similar to the embodiment shown in FIG. 8 with the addition of hot air hood 68 placed inside of belt press 64 to enhance the dewatering capability of belt press 64 in conjunction with vacuum roll 60.

Figure 10:
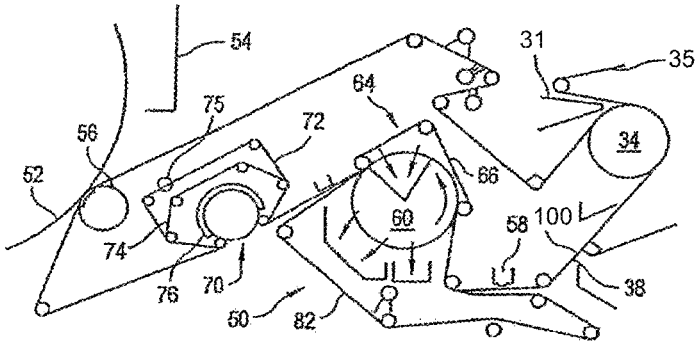
FIG. 10 illustrates a schematic cross-sectional view of another embodiment of an ATMOS™ papermaking machine.

Referring to FIG. 10, there is shown yet another embodiment of the present invention, which is substantially similar to the embodiment shown in FIG. 8, but including a boost dryer 70 which encounters structured fabric 100. Web 38 is subjected to a hot surface of boost dryer 70, and structured web 38 rides around boost dryer 70 with another woven fabric 72 riding on top of structured fabric 100. On top of woven fabric 72 is a thermally conductive fabric 74, which is in contact with both woven fabric 72 and a cooling jacket 76 that applies cooling and pressure to all fabrics and web 38. The pressing process does not negatively impact web quality. The drying rate of boost dryer 70 is above 400 kg/hr $m^2$ and preferably above 500 kg/hr $m^2$. The concept of boost dryer 70 is to provide sufficient pressure to hold web 38 against the hot surface of the dryer thus preventing blistering. Steam that is formed at the knuckle points of fabric 100 passes through fabric 100 and is condensed on fabric 72. Fabric 72 is cooled by fabric 74 that is in contact with cooling jacket 76, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending on the size of boost dryer 70, web 38 may be creped on the surface of boost dryer 70, thereby eliminating the need for Yankee dryer 52.

Figure 11:
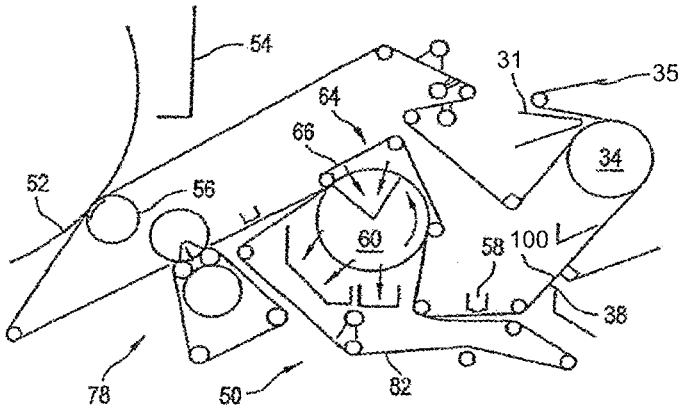
FIG. 11 illustrates a schematic cross-sectional view of another embodiment of an ATMOS™ papermaking machine.

Referring to FIG. 11, there is shown yet another embodiment of the present invention substantially similar to the invention disclosed in FIG. 8 but with an addition of an air press 78, which is a four roll cluster press that is used with high temperature air and is referred to as a High Pressure Through Air Dryer (HPTAD) for additional web drying prior to the transfer of web 38 to Yankee dryer 52. Four-roll cluster press 78 includes a main roll, a vented roll, and two cap rolls. The purpose of this cluster press is to provide a sealed chamber that is capable of being pressurized. The pressure chamber contains high temperature air, for example, 150° C. or higher and is at a significantly higher pressure than conventional TAD technology, for example, greater than 1.5 psi resulting in a much higher drying rate than a conventional TAD. The high-pressure hot air passes through an optional air dispersion fabric, through web 38 and structured fabric 100 into a vent roll. The air dispersion fabric may prevent web 38 from following one of the cap rolls. The air dispersion fabric is very open, having a permeability that equals or exceeds that of fabric structured 100. The drying rate of the HPTAD depends on the solids content of web 38 as it enters the HPTAD. The preferred drying rate is at least 500 kg/hr $m^2$, which is a rate of at least twice that of conventional TAD machines.

Advantages of the HPTAD process are in the areas of improved sheet dewatering without a significant loss in sheet quality and compactness in size and energy efficiency. Additionally, it enables higher pre-Yankee solids, which increase the speed potential of the invention. Further, the compact size of the HPTAD allows for easy retrofitting to an existing machine. The compact size of the HPTAD and the fact that it is a closed system means that it can be easily insulated and optimized as a unit to increase energy efficiency.

Figure 12:
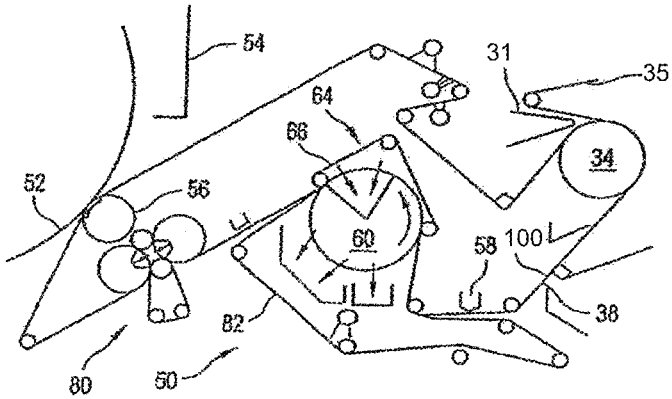
FIG. 12 illustrates a schematic cross-sectional view of another embodiment of an ATMOS™ papermaking machine.

Referring to FIG. 12, there is shown another embodiment of the present invention. This is significantly similar to the embodiments shown in FIGS. 8 and 11 except for the addition of a two-pass HPTAD 80. In this case, two vented rolls are used to double the dwell time of structured web 38 relative to the design shown in FIG. 11. An optional coarse mesh fabric may be used as in the previous embodiment. Hot pressurized air passes through web 38 carried on structured fabric 100 and onto the two vent rolls. It has been shown that depending on the configuration and size of the HPTAD, more than one HPTAD can be placed in series, which can eliminate the need for roll 60.

Figure 13:
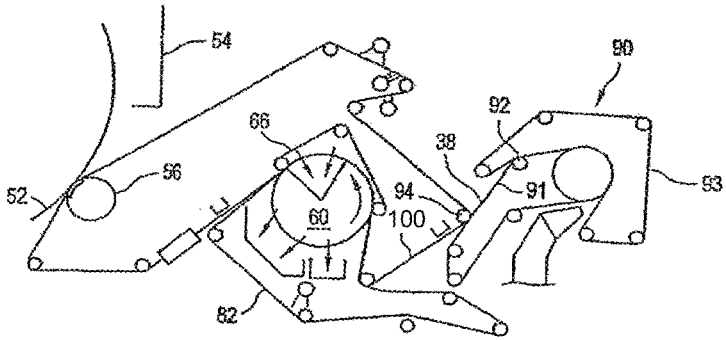
FIG. 13 illustrates a schematic cross-sectional view of another embodiment of an ATMOS™ papermaking machine.

Referring to FIG. 13, a conventional twin wire former 90 may be used to replace the crescent former shown in previous examples. The forming roll can be either a solid or open roll. If an open roll is used, care must be taken to prevent significant dewatering through the structured fabric to avoid losing basis weight in the pillow areas. The outer forming fabric 93 can be either a standard forming fabric or one such as that disclosed in U.S. Pat. No. 6,237,644. The inner fabric 91 should be a structured fabric that is much coarser than the outer forming fabric 93. For example, inner fabric 91 may be similar to structured fabric 100. A vacuum roll 92 may be needed to ensure that the web stays with structured fabric 91 and does not go with outer wire 93. Web 38 is transferred to structured fabric 100 using a vacuum device. The transfer can be a stationary vacuum shoe or a vacuum assisted rotating pick-up roll 94. The second structured fabric 100 is at least the same coarseness and preferably coarser than first structured fabric 91. The process from this point is the same as the process previously discussed in conjunction with FIG. 8. The registration of the web from the first structured fabric to the second structured fabric is not perfect, and as such some pillows will lose some basis weight during the expansion process, thereby losing some of the benefit of the present invention. However, this process option allows for running a differential speed transfer, which has been shown to improve some sheet properties. Any of the arrangements for removing water discussed above may be used with the twin wire former arrangement and a conventional TAD.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A structured fabric for use in a papermaking machine for forming a web of fibrous material, the structured fabric comprising:

a plurality of warp yarns; and a plurality of weft yarns, said plurality of warp and weft yarns being interwoven with one another in a repeating weave pattern, forming a web-facing side of the structured fabric, and forming a plurality of pockets each of which includes a plurality of margins and a bottom and is open on said web-facing side, said repeating weave pattern including:

said plurality of warp yarns including a plurality of warp knuckles each formed by floating over adjacent ones of said plurality of weft yarns on said web-facing side, said plurality of weft yarns including a first group of weft yarns and a second group of weft yarns, said first group of weft yarns, but not said second group of weft yarns, forming a plurality of weft knuckles each formed by floating over adjacent ones of said plurality of warp yarns on said web-facing side, said plurality of warp and weft knuckles being configured for impressing the web, said second group of weft yarns, but not said first group of weft yarns, forming at least partially a respective said bottom of each of said plurality of pockets, said plurality of pockets including a first type of pocket and a second type of pocket, said plurality of margins of said first type of pocket being formed only by said plurality of warp knuckles, said plurality of margins of said second type of pocket being formed by both said plurality of warp knuckles and said plurality of weft knuckles.

2. The structured fabric of claim 1, wherein each of said plurality of warp knuckles is formed by floating over at least three adjacent ones of said plurality of weft yarns on said web-facing side.

3. The structured fabric of claim 2, wherein each of said plurality of weft knuckles is formed by floating over at least three adjacent ones of said plurality of warp yarns on said web-facing side.

4. The structured fabric of claim 3, wherein said plurality of warp yarns extend in a machine direction of the structured fabric and said plurality of weft yarns extend in a cross-machine direction of the structured fabric.

5. The structured fabric of claim 4, wherein said repeating weave pattern is formed by a single layer of said plurality of warp and weft yarns and has five of said plurality of warp yarns and fifteen of said plurality of weft yarns.

6. The structured fabric of claim 5, wherein each of said plurality of warp yarns of said repeating weave pattern includes at least one of said plurality of warp knuckles, a respective one of said plurality of warp knuckles of each of said plurality of warp yarns being offset relative to another respective one of said plurality of warp knuckles of a respective adjacent one of said plurality of warp yarns by three of said plurality of weft yarns in said machine direction.

7. The structured fabric of claim 6, wherein a single said repeating weave pattern has only one of said first type of pocket and only two of said second type of pocket.

8. The structured fabric of claim 7, wherein, in said repeating weave pattern, said plurality of warp yarns includes a first warp yarn, a second warp yarn, a third warp yarn, a fourth warp yarn, and a fifth warp yarn, said plurality of weft yarns including a first weft yarn, a second weft yarn, a third weft yarn, a fourth weft yarn, a fifth weft yarn, a sixth weft yarn, a seventh weft yarn, an eighth weft yarn, a ninth weft yarn, a tenth weft yarn, an eleventh weft yarn, a twelfth weft yarn, a thirteenth weft yarn, a fourteenth weft yarn, and a fifteenth weft yarn, said first warp yarn weaving, relative to said web-facing side, under said first weft yarn, over said second weft yarn, under said third weft yarn, over said fourth, fifth, and sixth weft yarns, under said seventh and eighth weft yarns, over said ninth, tenth, and eleventh weft yarns, under said twelfth weft yarn, over said thirteenth weft yarn, and under said fourteenth and fifteenth weft yarns, said second warp yarn weaving, relative to said web-facing side, over said first weft yarn, under said second, third, and fourth weft yarns, over said fifth weft yarn, under said sixth weft yarn, over said seventh, eighth, and ninth weft yarns, under said tenth and eleventh weft yarns, over said twelfth, thirteenth, and fourteenth weft yarns, and under said fifteenth weft yarn, said third warp yarn weaving, relative to said web-facing side, over said first and second weft yarns, under said third weft yarn, over said fourth weft yarn, under said fifth, sixth, and seventh weft yarns, over said eighth weft yarn, under said ninth weft yarn, over said tenth, eleventh, and twelfth weft yarns, under said thirteenth and fourteenth weft yarns, and over said fifteenth weft yarn, said fourth warp yarn weaving, relative to said web-facing side, under said first and second weft yarns, over said third, fourth, and fifth weft yarns, under said sixth weft yarn, over said seventh weft yarn, under said eighth, ninth, and tenth weft yarns, over said eleventh weft yarn, under said twelfth weft yarn, and over said thirteenth, fourteenth, and fifteenth weft yarns, said fifth warp yarn weaving, relative to said web-facing side, over said first, second, and third weft yarns, under said fourth and fifth weft yarns, over said sixth, seventh, and eighth weft yarns, under said ninth weft yarn, over said tenth weft yarn, under said eleventh, twelfth, and thirteenth weft yarns, over said fourteenth weft yarn, and under said fifteenth weft yarn, said first warp yarn forming one of said plurality of warp knuckles when weaving over said fourth, fifth, and sixth weft yarns and another of said plurality of warp knuckles when weaving over said ninth, tenth, and eleventh weft yarns, said second warp yarn forming one of said plurality of warp knuckles when weaving over said seventh, eighth, and ninth weft yarns and another of said plurality of warp knuckles when weaving over said twelfth, thirteenth, and fourteenth weft yarns, said third warp yarn forming one of said plurality of warp knuckles when weaving over said tenth, eleventh, and twelfth weft yarns, said fourth warp yarn forming one of said plurality of warp knuckles when weaving over said third, fourth, and fifth weft yarns and another of said plurality of warp knuckles when weaving over said thirteenth, fourteenth, and fifteenth weft yarns, said fifth warp yarn forming one of said plurality of warp knuckles when weaving over said first, second, and third weft yarns and another of said plurality of warp knuckles when weaving over said sixth, seventh, and eighth weft yarns, said third weft yarn forming one of said plurality of weft knuckles when weaving over said first, second, and third warp yarns, said sixth weft yarn forming one of said plurality of weft knuckles when weaving over said second, third, and fourth warp yarns, said ninth weft yarn forming one of said plurality of weft knuckles when weaving over said third, fourth, and fifth warp yarns.

9. The structured fabric of claim 8, wherein, when the structured fabric includes two of said repeating weave pattern which are adjacent one another in said cross-machine direction, the structured fabric forms four of said plurality of pockets of said first type of pocket and six of said plurality of pockets of said second type of pocket by way of said two of said repeating weave pattern and at least two of said plurality of weft knuckles are formed across a junction of said two of said repeating weave pattern.

10. The structured fabric of claim 5, wherein, in said repeating weave pattern, said plurality of warp yarns includes at least one warp yarn n and at least one warp yarn n+1, a warp path for each said warp yarn n+1 being offset in said machine direction by three of said plurality of weft yarns relative to a respective said warp yarn n, each one of said plurality of warp yarns weaving, relative to web-facing side, a following said warp path: over three of said plurality of weft yarns, then under two of said plurality of weft yarns, then over three of said plurality of weft yarns, then under one of said plurality of weft yarn, then over one of said plurality of weft yarn, then under three of said plurality of weft yarns, then over one of said plurality of weft yarn, then under one of said plurality of weft yarn.

11. A papermaking machine for forming a web of fibrous material, the papermaking machine comprising:

a structured fabric for use in the papermaking machine, said structured fabric including:

a plurality of warp yarns; and a plurality of weft yarns, said plurality of warp and weft yarns being interwoven with one another in a repeating weave pattern, forming a web-facing side of the structured fabric, and forming a plurality of pockets each of which includes a plurality of margins and a bottom and is open on said web-facing side, said repeating weave pattern including:

said plurality of warp yarns including a plurality of warp knuckles each formed by floating over adjacent ones of said plurality of weft yarns on said web-facing side, said plurality of weft yarns including a first group of weft yarns and a second group of weft yarns, said first group of weft yarns, but not said second group of weft yarns, forming a plurality of weft knuckles each formed by floating over adjacent ones of said plurality of warp yarns on said web-facing side, said plurality of warp and weft knuckles being configured for impressing the web, said second group of weft yarns, but not said first group of weft yarns, forming at least partially a respective said bottom of each of said plurality of pockets, said plurality of pockets including a first type of pocket and a second type of pocket, said plurality of margins of said first type of pocket being formed only by said plurality of warp knuckles, said plurality of margins of said second type of pocket being formed by both said plurality of warp knuckles and said plurality of weft knuckles.

12. The papermaking machine of claim 11, wherein each of said plurality of warp knuckles is formed by floating over at least three adjacent ones of said plurality of weft yarns on said web-facing side.

13. The papermaking machine of claim 12, wherein each of said plurality of weft knuckles is formed by floating over at least three adjacent ones of said plurality of warp yarns on said web-facing side.

14. The papermaking machine of claim 13, wherein said plurality of warp yarns extend in a machine direction of the structured fabric and said plurality of weft yarns extend in a cross-machine direction of the structured fabric.

15. The papermaking machine of claim 14, wherein said repeating weave pattern is formed by a single layer of said plurality of warp and weft yarns and has five of said plurality of warp yarns and fifteen of said plurality of weft yarns.

16. The papermaking machine of claim 15, wherein each of said plurality of warp yarns of said repeating weave pattern includes at least one of said plurality of warp knuckles, a respective one of said plurality of warp knuckles of each of said plurality of warp yarns being offset relative to another respective one of said plurality of warp knuckles of a respective adjacent one of said plurality of warp yarns by three of said plurality of weft yarns in said machine direction.

17. The papermaking machine of claim 16, wherein a single said repeating weave pattern has only one of said first type of pocket and only two of said second type of pocket.

18. The papermaking machine of claim 15, wherein, in said repeating weave pattern, said plurality of warp yarns includes at least one warp yarn n and at least one warp yarn n+1, a warp path for each said warp yarn n+1 being offset in said machine direction by three of said plurality of weft yarns relative to a respective said warp yarn n, each one of said plurality of warp yarns weaving, relative to web-facing side, a following said warp path: over three of said plurality of weft yarns, then under two of said plurality of weft yarns, then over three of said plurality of weft yarns, then under one of said plurality of weft yarn, then over one of said plurality of weft yarn, then under three of said plurality of weft yarns, then over one of said plurality of weft yarn, then under one of said plurality of weft yarn.

19. A web of fibrous material, comprising:

a fibrous construct having at least one formed surface feature, said surface feature including a topographical pattern reflective of a repeating weave pattern in a fabric used in a papermaking machine, said fabric being a structured fabric and including:

a plurality of warp yarns; and a plurality of weft yarns, said plurality of warp and weft yarns being interwoven with one another in said repeating weave pattern, forming a web-facing side of the structured fabric, and forming a plurality of pockets each of which includes a plurality of margins and a bottom and is open on said web-facing side, said repeating weave pattern including:

said plurality of warp yarns including a plurality of warp knuckles each formed by floating over adjacent ones of said plurality of weft yarns on said web-facing side, said plurality of weft yarns including a first group of weft yarns and a second group of weft yarns, said first group of weft yarns, but not said second group of weft yarns, forming a plurality of weft knuckles each formed by floating over adjacent ones of said plurality of warp yarns on said web-facing side, said plurality of warp and weft knuckles being configured for impressing the web, said second group of weft yarns, but not said first group of weft yarns, forming at least partially a respective said bottom of each of said plurality of pockets, said plurality of pockets including a first type of pocket and a second type of pocket, said plurality of margins of said first type of pocket being formed only by said plurality of warp knuckles, said plurality of margins of said second type of pocket being formed by both said plurality of warp knuckles and said plurality of weft knuckles.

* * * * *